US008710755B2

(12) United States Patent
Chen et al.

(10) Patent No.: US 8,710,755 B2
(45) Date of Patent: Apr. 29, 2014

(54) LIGHT EMITTING DEVICE POWER SUPPLY CIRCUIT, AND LIGHT EMITTING DEVICE DRIVER CIRCUIT AND CONTROL METHOD THEREOF

(75) Inventors: Pei-Yuan Chen, Longtan Township, Taoyuan County (TW); Chia-Wei Liao, Zhubei (TW); Jing-Meng Liu, Zhubei (TW); Leng-Nien Hsiu, Zhubei (TW)

(73) Assignee: Richtek Technology Corporation, Chupei, Hsin-Chu (TW)

( * ) Notice: Subject to any disclaimer, the term of this patent is extended or adjusted under 35 U.S.C. 154(b) by 163 days.

(21) Appl. No.: 13/421,733

(22) Filed: Mar. 15, 2012

(65) Prior Publication Data

US 2012/0242238 A1 Sep. 27, 2012

Related U.S. Application Data

(60) Provisional application No. 61/466,118, filed on Mar. 22, 2011.

(51) Int. Cl.
*H05B 37/02* (2006.01)

(52) U.S. Cl.
USPC ..... 315/200 R; 315/176; 315/194; 315/209 R

(58) Field of Classification Search
USPC ..... 315/176, 194, 200 R, 209 R, 211, 246, 315/247, 291, 294, 295, 297, 287, 307–309
See application file for complete search history.

(56) References Cited

U.S. PATENT DOCUMENTS

| | | | | |
|---|---|---|---|---|
| 7,656,103 | B2 * | 2/2010 | Shteynberg et al. | 315/312 |
| 7,902,769 | B2 * | 3/2011 | Shteynberg et al. | 315/291 |
| 8,222,832 | B2 * | 7/2012 | Zheng et al. | 315/291 |

* cited by examiner

*Primary Examiner* — Vibol Tan
(74) *Attorney, Agent, or Firm* — Tung & Associates

(57) ABSTRACT

The present invention discloses a light emitting device power supply circuit, a light emitting device driver circuit and a control method thereof. The light emitting device driver circuit is coupled to a tri-electrode AC switch (TRIAC) dimmer circuit, and it controls the brightness of a light emitting device circuit according a rectified dimming signal. The light emitting device driver circuit includes a power stage circuit and a light emitting device control circuit. The light emitting device control circuit generates a switch control signal. The power stage circuit operates at least one power switch thereof according to the switch control signal to generate a latching current for firing the TRIAC dimmer circuit, and the latching current is inputted to the light emitting device circuit.

16 Claims, 7 Drawing Sheets

LIGHT EMITTING DEVICE POWER SUPPLY CIRCUIT, AND LIGHT EMITTING DEVICE DRIVER CIRCUIT AND CONTROL METHOD THEREOF

CROSS REFERENCE

The present invention claims priority to U.S. provisional application No. 61/466,118, filed on Mar. 22, 2011.

BACKGROUND OF THE INVENTION

1. Field of Invention

The present invention relates to a light emitting device power supply circuit, a light emitting device driver circuit and a control method thereof. Particularly, it relates to such light emitting device power supply circuit, light emitting device driver circuit and control method thereof which generate a latching current for firing a TRIAC device, wherein latching current is guided to an output node, such that the power utilization efficiency is improved and less flicker occurs.

2. Description of Related Art

FIG. 1A shows a schematic diagram of a prior art light emitting diode (LED) power supply circuit. As shown in FIG. 1A, the LED power supply circuit includes a tri-electrode AC switch (TRIAC) dimming circuit 12, a rectifier circuit 14, and an LED driver circuit 16. The TRIAC dimming circuit 12 receives an AC signal from an AC input line node VL. When the AC signal exceeds a predetermined trigger phase, the TRIAC dimming circuit 12 fires and turns ON. FIG. 1B shows a schematic diagram of the input and output signal waveforms of the TRIAC dimming circuit 12. The AC signal at the AC input line node VL is shown by a dash line, and the AC dimming signal at the node VL' after the TRIAC dimming circuit 12 is shown by a solid line. The rectifier circuit 14 receives the AC dimming signal at the node VL', and rectifies it to generate a rectified dimming signal which is inputted to the LED driver circuit 16 for driving the LED circuit 11 and adjusting its brightness.

One of the drawbacks of the aforementioned prior art is that the TRIAC dimming circuit 12 includes a TRIAC device, and the TRIAC device requires a large latching current to fire. If what the power supply drives is a high power consuming load circuit, such as a conventional incandescent lamp, the latching current for the TRIAC device is sufficient. However if what the power supply drives is a low power consuming load circuit, such as the LED circuit 11, the latching current for the TRIAC device is insufficient because of the low current of the LED circuit 11. If the power supply circuit does not generate a sufficient latching current to fire the TRIAC device, a so-called "misfire" occurs and the LED circuit 11 will flicker perceptibly. FIG. 1C shows the waveforms of the signals at the nodes VL and VL' when the misfire condition occurs.

FIGS. 2A and 2B show schematic diagrams of another prior art LED power supply circuit which solves the misfire problem of the aforementioned prior art. Different from the prior art LED power supply circuit shown in FIG. 1A, the prior art LED power supply circuit shown in FIG. 2A further includes a bleeder circuit 18 between the rectifier circuit 14 and the LED driver circuit 16; the bleeder circuit 18 is designed for generating the latching current in every cycle for firing the TRIAC device of the TRIAC dimming circuit 12. The latching current generated by the bleeder circuit 18 is consumed through a path connecting to ground. FIG. 2B shows a more specific example of the bleeder circuit 18.

More specifically, in the bleeder circuit 18, resistors R1 and R2 are connected in series between two output nodes of the rectifier circuit 14, and a division voltage at the node between the resistors R1 and R2 turns ON a switch Q1 to generate the latching current. A resistor R3 and Zener diodes ZD1 and ZD2 are connected in series between the two output nodes of the rectifier circuit 14, and a division voltage at the node between the resistor R3 and the Zener diode ZD1 turns ON a switch Q2 to generate the holding current for maintaining the TRIAC operation; the holding current flows through a resistor R4.

Although the prior art shown in FIGS. 2A and 2B solves the misfire problem and hence solves the flicker problem of the LED circuit, the power consumed by the bleeder circuit 18 is wasted.

In view of the foregoing, the present invention provides a light emitting device power supply circuit, alight emitting device driver circuit and a control method thereof to improve the drawback of the prior art. Particularly, the present invention generates a latching current for firing a TRIAC device, and the latching current is guided to an output node which supplies power to the light emitting device, so that unnecessary power consumption is reduced while the flicker problem is solved.

SUMMARY OF THE INVENTION

The first objective of the present invention is to provide a light emitting device driver circuit.

The second objective of the present invention is to provide a control method of a light emitting device.

The third objective of the present invention is to provide a light emitting device power supply circuit.

To achieve the objectives mentioned above, from one perspective, the present invention provides a light emitting device driver circuit for driving a light emitting device circuit according to a rectified dimming signal, wherein the rectified dimming signal is generated from an AC input signal which passes through a tri-electrode AC switch (TRIAC) dimming circuit and a rectifier circuit, the light emitting device driver circuit comprising: a power stage circuit coupled between the rectifier circuit and the light emitting device circuit, the power stage circuit operating at least one power switch therein according to a switch control signal to generate a latching current for firing the TRIAC dimming circuit, wherein the latching current flows through the light emitting device circuit; and a light emitting device control circuit coupled to the power stage circuit, the light emitting device control circuit generating the switch control signal according to a detection signal.

From another perspective, the present invention provides a light emitting device control method, comprising: receiving a rectified dimming signal, wherein the rectified dimming signal is generated from an AC input signal which passes through a tri-electrode AC switch (TRIAC) dimming circuit and a rectifier circuit; generating a switch control signal according to a detection signal; controlling at least one power switch of a power stage circuit according to the switch control signal to generate a latching current for firing the TRIAC dimming circuit; and inputting the latching current to the light emitting device.

From another perspective, the present invention provides a light emitting device power supply circuit, comprising: a tri-electrode AC switch (TRIAC) dimming circuit, which generates an AC dimming signal according to an AC input signal; a rectifier circuit, which generates a rectified dimming signal according to the AC dimming signal; and a light emitting device driver circuit for driving a light emitting device circuit according to the rectified dimming signal, the light emitting device driver circuit including: a power stage circuit coupled between the rectifier circuit and the light emitting device circuit, the power stage circuit operating at least one power switch therein according to a switch control signal to generate a latching current for firing the TRIAC dimming circuit, wherein the latching current flows through the light emitting device circuit; and a light emitting device control circuit coupled to the power stage circuit, the light emitting device control circuit generating the switch control signal according to a detection signal.

In one embodiment, the detection signal is preferably generated according to at least one method below: (1) by detecting the rectified dimming signal or a signal related to the rectified dimming signal, and the detection signal is generated when the rectified dimming signal is at a neutral level or below a predetermined level; (2) by detecting an input or an output current flowing through the power stage circuit or a signal related to the input or the output current, and the detection signal is generated when the input or the output current is zero; and (3) by generating the detection signal with a frequency corresponding to a frequency of the AC input signal or the rectified dimming signal.

In the aforementioned embodiment, the light emitting device driver circuit preferably further includes a voltage detection circuit coupled to the rectifier circuit to detect the rectified dimming signal or the signal related to the rectified dimming signal.

In the aforementioned embodiment, the power stage circuit preferably further includes: a current detection circuit coupled to the power switch to detect the input or the output current; and an inductor device, which is coupled to the power switch to generate the latching current.

In one embodiment, the light emitting device control circuit preferably includes: a comparator circuit, which compares the detection signal and the rectified dimming signal or a signal related to the rectified dimming signal, to generate a trigger signal according to the comparison result; and a latch circuit, which determines an ON time of the switch control signal according to the trigger signal.

The objectives, technical details, features, and effects of the present invention will be better understood with regard to the detailed description of the embodiments below.

DESCRIPTION OF THE PREFERRED EMBODIMENTS

Figure 1A:
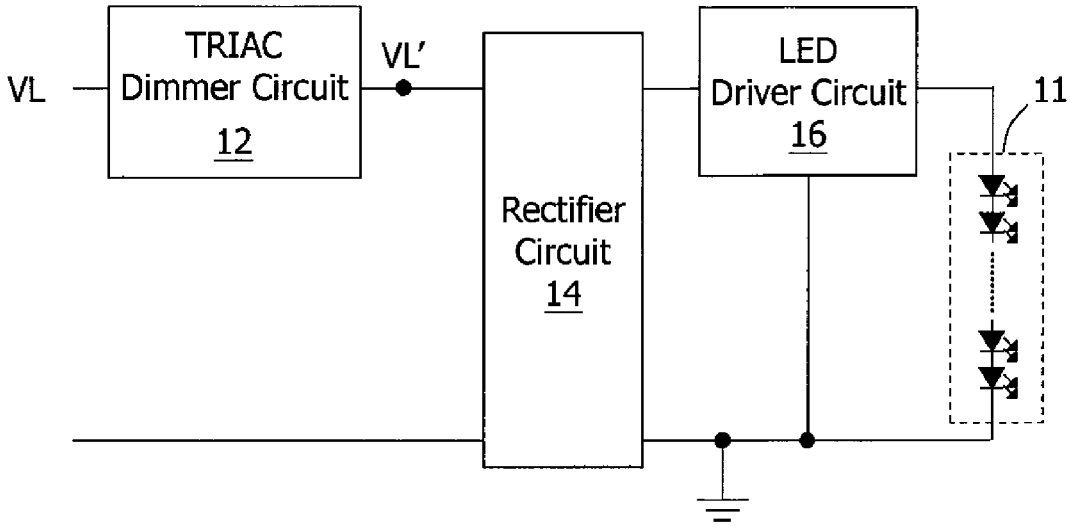
Fig. 1A (Prior Art)
FIG. 1A shows a schematic diagram of a prior art light emitting diode (LED) power supply circuit.
Figure 1B:
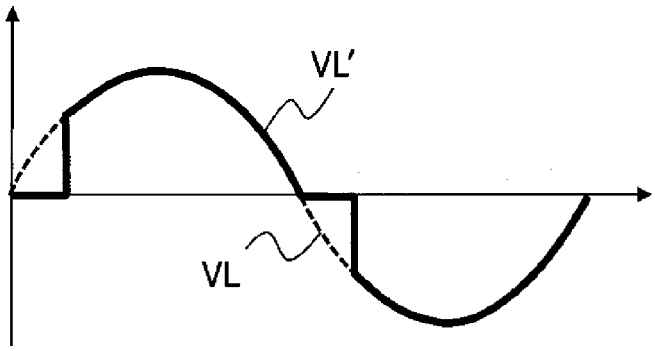
Fig. 1B (Prior Art)
FIGS. 1B and 1C show AC signal waveforms of the TRIAC dimming circuit 12 with sufficient and insufficient latching current for firing the TRIAC device, respectively.
Figure 1C:
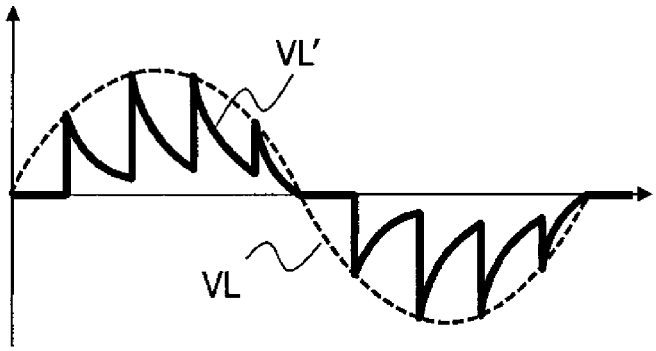
Fig. 1C (Prior Art)
Figure 2A:
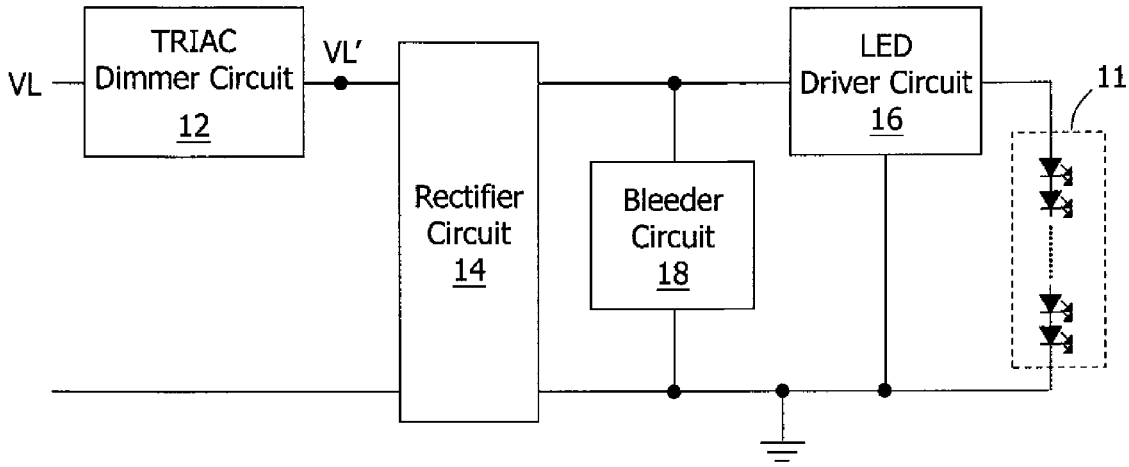
Fig. 2A (Prior Art)
FIGS. 2A and 2B show schematic diagrams of another prior art LED power supply circuit.
Figure 2B:
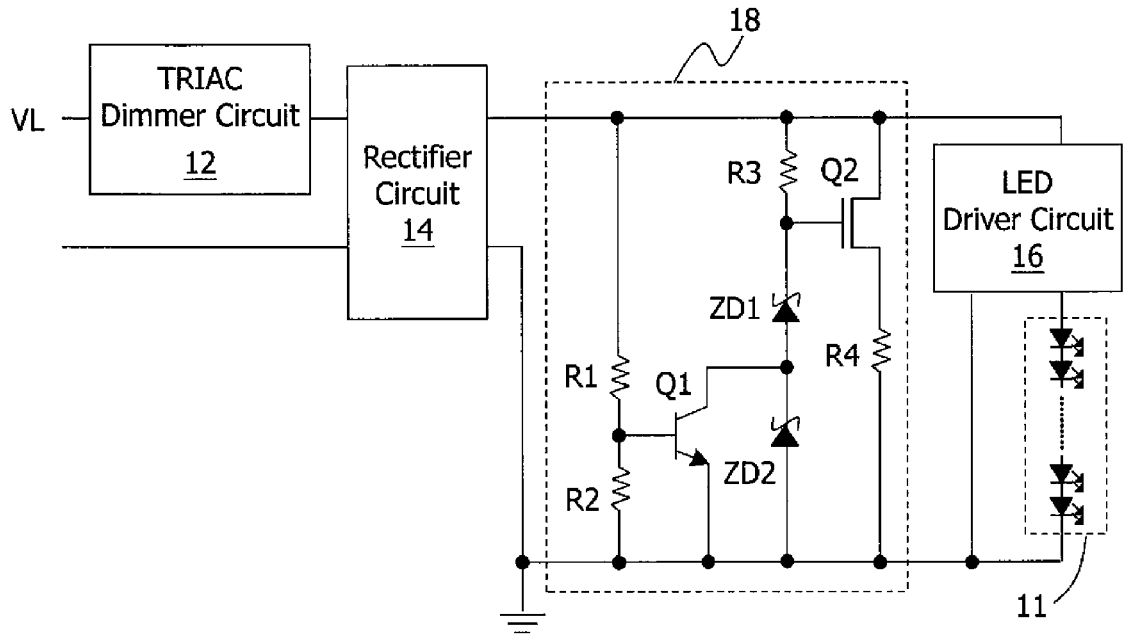
Fig. 2B (Prior Art)
Figure 3:
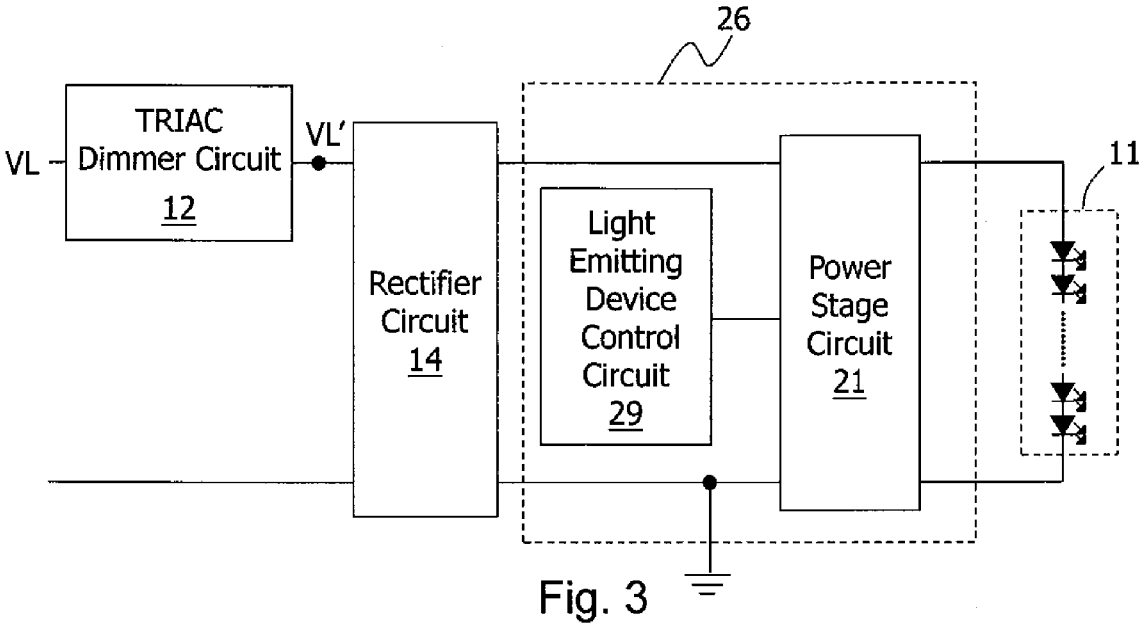
FIG. 3 shows a first embodiment of the present invention.
Figure 4A:
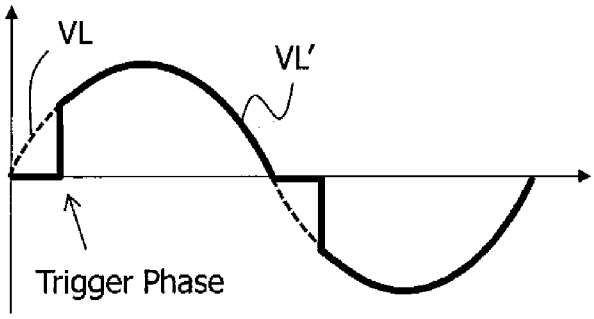
FIG. 4A shows AC input signal waveforms before and after the TRIAC dimming circuit, respectively.
Figure 4B:
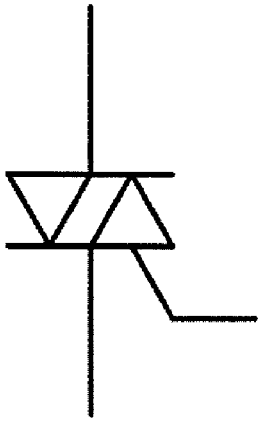
FIG. 4B shows an SCR device symbol.
Figure 4C:
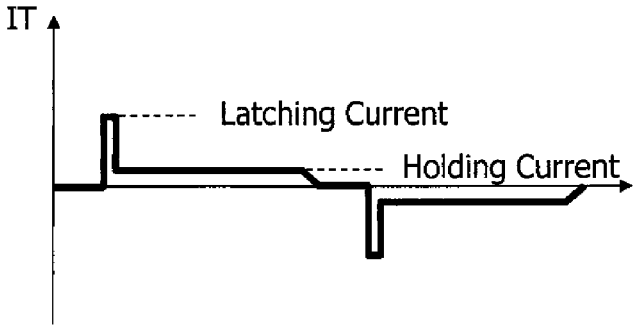
FIG. 4C shows a schematic diagram of the waveform of the TRIAC device current IT.

FIG. 3 shows a first embodiment of the present invention. As shown in the figure, a light emitting device power supply circuit includes a tri-electrode AC switch (TRIAC) dimming circuit 12, a rectifier circuit 14, and a light emitting device driver circuit 26. The TRIAC dimming circuit 12 receives an AC signal from the AC input line node VL, having a signal waveform as shown by the dash line in FIG. 4A. When the AC signal exceeds a predetermined trigger phase, the TRIAC dimming circuit 12 fires and turns ON. The TRIAC dimming circuit 12 generates an AC dimming signal at the signal node VL', having a signal waveform as shown by the solid line in FIG. 4A. The TRIAC dimming circuit 12 includes a TRIAC device, which for example includes two silicon control rectifier (SCR) devices. FIG. 4B shows a symbol of an TRIAC device. The TRIAC device and the SCR device are well known by those skilled in the art, so details thereof are omitted here. In the operation of the TRIAC device, a higher latching current for firing the TRIAC device and a lower holding current for maintaining the operation of the TRIAC device are required. FIG. 4C shows a typical waveform of the TRIAC device current IT, including the latching current and the holding current. The rectifier circuit 14 is for example but not limited to a bridge rectifier circuit (not shown), which converts the AC dimming signal with positive and negative portions to a positive rectified dimming signal. The light emitting device driver circuit 26 receives the rectified dimming signal and controls the brightness of a light emitting device circuit accordingly. The light emitting device circuit is for example but not limited to the LED circuit 11. The light emitting device driver circuit 26 includes a power stage circuit 21 and a light emitting device control circuit 29. The power stage circuit 21 is coupled between the rectifier circuit 14 and the LED circuit 11. The power stage circuit 21 operates at least one power switch thereof according to a switch control signal to generate an output current which is supplied to the LED circuit 11; the output current generated by the power stage circuit 21 includes the latching current for firing the TRIAC circuit 12. The light emitting device control circuit 29 is coupled to the power stage circuit 21; it generates the aforementioned switch control signal to control the power stage circuit 21. The switch control signal is generated according to a detection signal.

One key feature of the present invention is that: the current generated by the light emitting device driver circuit 26 is not only for meeting the requirement by the LED circuit 11, but it also includes the latching current for firing the TRIAC dimming circuit 12; the latching current for firing the TRIAC dimming circuit 12 is generated by the light emitting device driver circuit 26, and the latching current is guided to the LED circuit 11 under control by the light emitting device driver circuit 26, rather than flowing to ground. Therefore, compared to the prior art, the present invention can avoid misfire while in the mean time save the power consumed by the bleeder circuit.

In the present invention, the generation of the latching current is controlled by the operation of the power switch of the power stage circuit 21. Therefore, the simplest way to generate the latching current is: starting from the timing when it is required to fire the TRIAC dimming circuit 12, the power switch is turned ON completely for several periods. This method also belongs to the scope of the present invention, but the circuit response time is relatively slow. According to the present invention, a preferred method is to turn ON the power switch in advance (that is, before the trigger phase). In one embodiment, the light emitting device control circuit 29 generates the detection signal according to at least one method below, and turns ON the power switch in advance according to the detection signal:

(1) by detecting the rectified dimming signal or a signal related to the rectified dimming signal, and the detection signal is generated when the rectified dimming signal is at a neutral level or below a predetermined level;

(2) by detecting an input or an output current flowing through the power stage circuit or a signal related to the input or the output current, and the detection signal is generated when the input or the output current is zero; and (3) by generating the detection signal with a frequency corresponding to a frequency of the AC input signal or the rectified dimming signal.

The methods listed above are illustrative examples, not for limiting the scope of the present invention. Those skilled in this art can readily conceive variations and modifications within the spirit of the present invention. For example, the neutral level or zero current needs not be a precise neutral level or zero current, but instead may be a predetermined relatively lower level or current. For another example, after the detection signal is generated, the power switch of the power stage circuit 21 may be completely turned ON immediately, partially turned ON immediately, or completely or partially turned ON after a short delay, according to the requirement for the latching current, the design by the circuit designer or the requirement from the user. In summary, in every period, when the rectified dimming signal reaches its trigger phase, the power switch of the power stage circuit 21 has already been turned ON sufficiently so that sufficient latching current is generated for firing the TRIAC dimming circuit 12, and thereafter the power switch of the power stage circuit 21 is controlled to regulate the output current of the power stage circuit 21. More details will be described later.

Figure 5:
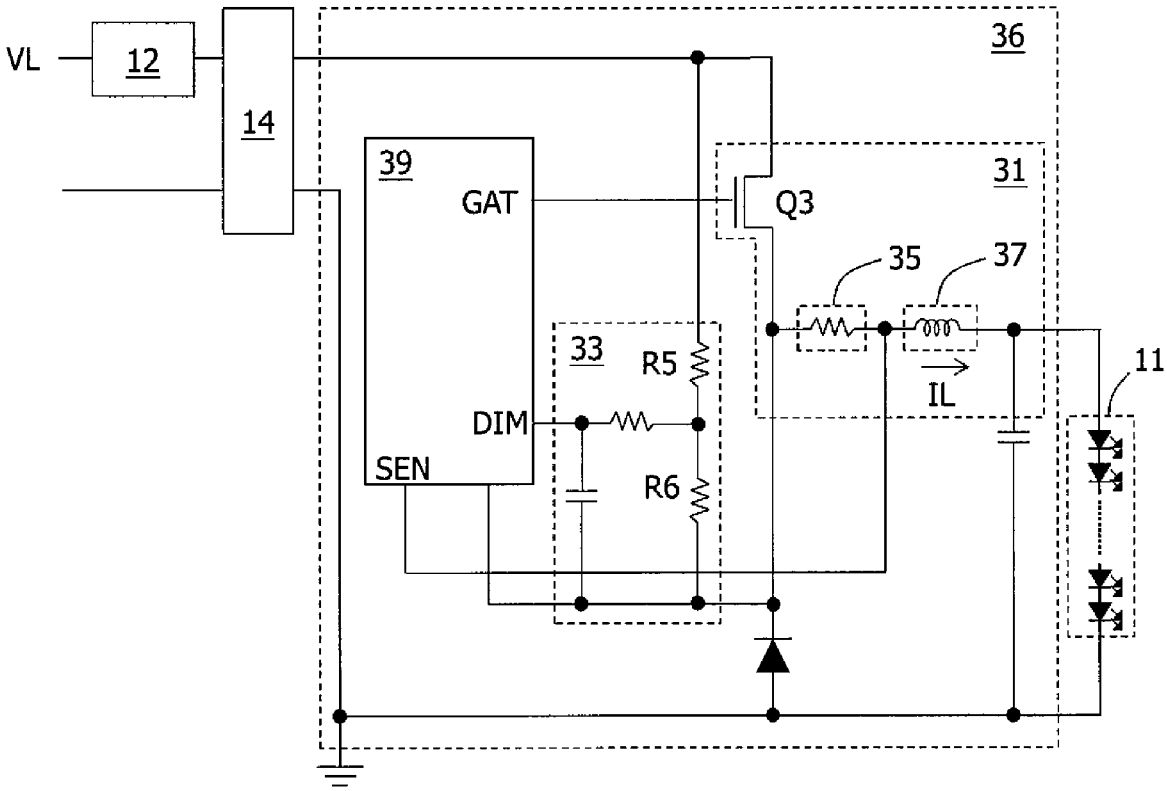
FIG. 5 a second embodiment of the present invention.

FIG. 5 shows a second embodiment of the present invention. This embodiment shows an example that the light emitting device power supply circuit includes a light emitting device driver circuit 36 which is a non-isolated buck switching regulator. Note that this is only one embodiment of the present invention. The light emitting device driver circuit may be any proper structure. Referring to FIG. 5, the light emitting device driver circuit 36 includes a light emitting device control circuit 39, a power stage circuit 31, and a voltage detection circuit 33. The voltage detection circuit 33 is coupled to the rectifier circuit 14 to detect the rectified dimming signal outputted from the rectifier circuit 14, or its related signal. The voltage detection circuit 33 for example may include a voltage division circuit, which includes resistors R5 and R6 connected in series. One end of the resistor R5 is electrically connected to the rectifier circuit 14, and the voltage division node between the resistors R5 and R6 is coupled to a dimming signal pin DIM of the light emitting device control circuit 39. When the rectified dimming signal is at neutral level, the level of the voltage division node is also at neutral level. Therefore, the light emitting device control circuit 39 can detect the time point when the rectified dimming signal is at neutral level, and control a power switch Q3 of the power stage circuit 31 accordingly. For example, when the rectified dimming signal is at neutral level (not necessarily precisely at this time point, but may be a time point afterward), the light emitting device control circuit 39 generates a switch control signal which is outputted from a switch control signal pin GAT to turn ON the power switch Q3. Thus, when the rectified dimming signal reaches its trigger phase, because the power switch Q3 has been turned ON already, the power stage circuit 31 will instantly generate the latching current for firing the TRIAC dimming circuit 12, and furthermore the latching current is supplied to the LED circuit 11 via power stage circuit 31.

In FIG. 5, the preferable embodiment of the voltage detection circuit 33 further includes a low pass filter, which includes a resistor and a capacitor. The function of the low pass filter is to filter high frequency noises. However, the low pass filter is not necessarily required and may be omitted.

FIG. 5 also shows another detection method. As shown in the figure, the power stage circuit 31 includes not only the power switch Q3 and an inductor 37, but also includes a current detection circuit 35. The current detection circuit 35 is for example but not limited to a resistor as shown in the figure, which is coupled to the power switch Q3 to detect the inductor current IL or its related signal, and it sends a detection signal to the light emitting device control circuit 39 via a sense pin SEN. The light emitting device control circuit 39 also can control the power switch Q3 of the power stage circuit 31 according to the detection signal from the sense pin SEN. For example, when or after the inductor current IL is zero, the light emitting device control circuit 39 generates the switch control signal to turn ON the power switch Q3, such that when the rectified dimming signal reaches its trigger phase, as described in the above, sufficient latching current is immediately generated for firing the TRIAC circuit 12, and the latching current is supplied to the LED circuit 11.

As alternative examples, the zero current time point can also be detected by comparing the voltages at the source and drain of the power switch Q3, and the current detection circuit 35 can be located at other positions of the current path.

As another example to turn ON the power switch Q3 in advance, a clock signal may be generated inside or outside the light emitting device driver circuit 36, which has the same frequency as the AC signal at the AC input line node VL or has the same frequency as the rectified dimming signal outputted from the rectifier circuit 14, and the power switch Q3 may be turned ON at proper time points according to the clock signal.

In view of the foregoing, there are various methods to generate the detection signal for turning ON the power switch Q3 to generate the latching current; all such methods are within the scope of the present invention. In the second embodiment, both the voltage detection circuit 33 and the current detection circuit 35 are included, but either one is sufficient to generate the detection signal (by detecting the neutral level or the zero current); the other one can be used for feedback controlling the power switch Q3 after the latching current for firing the TRIAC device is generated. For example, in this second embodiment, the signal obtained from the pin DIM may be used to determine the time point to generate the latching current, and the signal obtained at the pin SEN may be used for feedback control to regulate the output current of the power stage circuit 31.

Figure 6A:
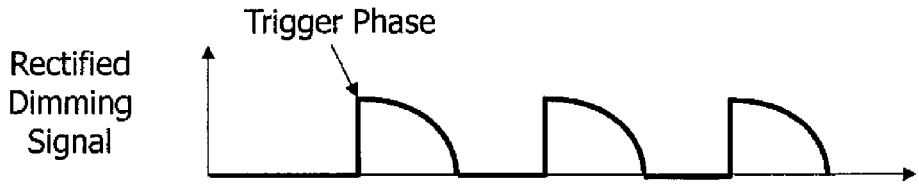
FIGS. 6A-6D show signal waveforms of the rectified dimming signal, the inductor current flowing through an inductor circuit 37, the switch control signal, and the light emitting device current IL flowing through the LED circuit 11.
Figure 6B:
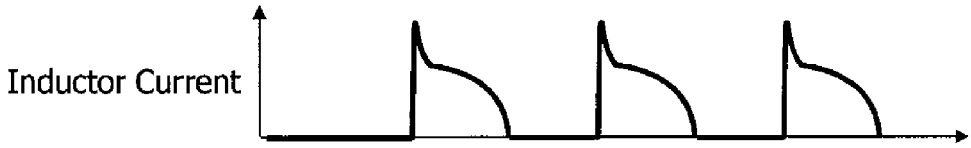
Figure 6C:
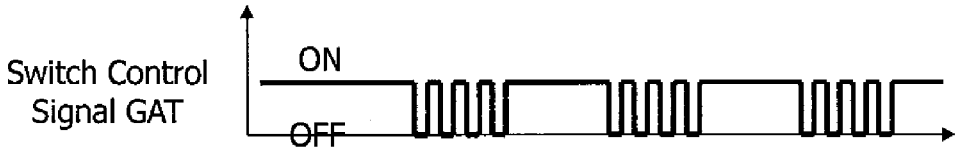
Figure 6D:
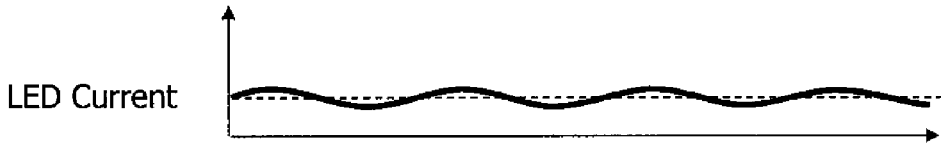

FIGS. 6A-6D show signal waveforms of the rectified dimming signal, the inductor current IL flowing through the inductor circuit 37, the switch control signal GAT, and the LED current IL, respectively. Referring to FIGS. 6A-6D and the second embodiment of FIG. 5, the AC signal at the AC input line node VL is subject to a phase cut by the TRIAC dimming circuit 12 and rectified by the rectifier circuit 14, to generate the rectified dimming signal as shown in FIG. 6A. As shown in FIG. 6C, when it is detected that the rectified dimming signal is at the neutral level, the switch control signal GAT turns ON the power switch Q3 (not necessarily precisely at this time point, but may be a time point afterward as explained previously; what the figure shows is only one example), and therefore, at the trigger phase, a high inrush current is generated. This inrush current is used to generate the latching current for firing the TRIAC device. Thereafter, the power switch Q3 is controlled by a pulse width modulation (PWM) signal, so the inductor current has a signal waveform as shown in FIG. 6B. FIG. 6D shows the waveform of the LED current flowing through the LED circuit 11.

Figure 6E:
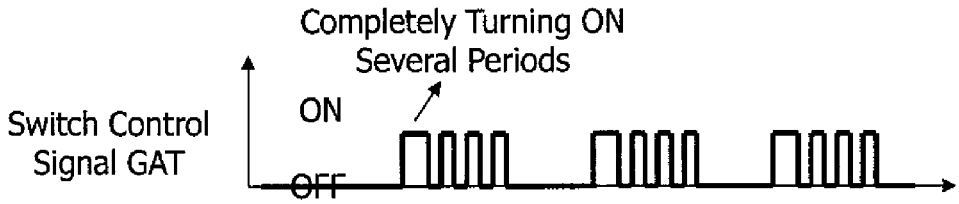
FIG. 6E shows another embodiment of the switch control signal.

It can be understood from the above description that, as long as the power switch Q3 has been turned ON before the rectified dimming signal reaches its trigger phase, a high inrush current can be induced to generate the latching current for firing the TRIAC device. Therefore, the time point to turn ON the power switch Q3 does not have to be exactly the time point when the rectified dimming signal is at the neutral level, but may be any time point before the trigger phase of the rectified dimming signal. And, the method of generating the inrush current and the latching current by turning ON the power switch Q3 in advance is only one embodiment of the present invention. For example, referring to FIG. 6E, the latching current may also be generated not by turning ON the power switch Q3 in advance, but by completely turning ON the power switch Q3 for several periods at the trigger phase of the rectified dimming signal; this method is also within the scope of the present invention, except that this method has a relatively slower response speed. In this latter method, the power switch Q3 is turned ON continuously for several periods after the trigger phase of the rectified dimming signal is detected (for example, the detection signal may be generated when the rectified dimming signal or its related signal changes from the neutral level to a predetermined level), and it is not required to detect the time point when the rectified dimming signal is at the neutral level or when the inductor current is zero.

Figure 7:
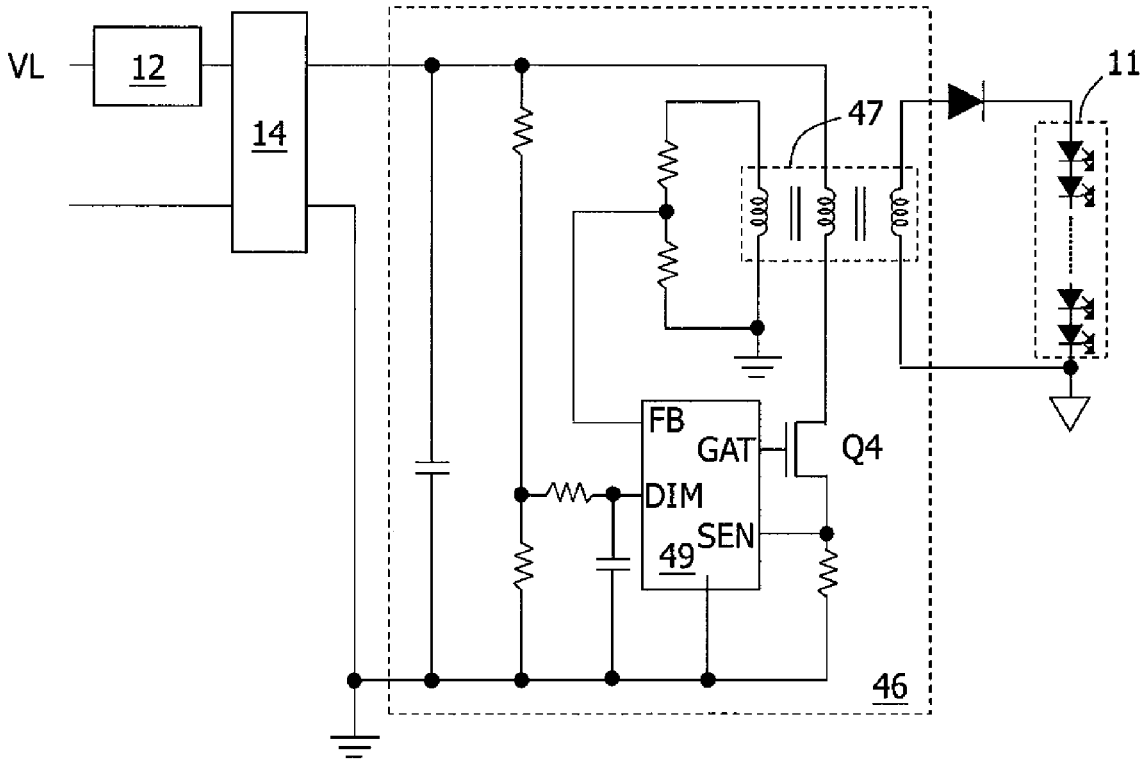
FIG. 7 shows a third embodiment of the present invention.

FIG. 7 shows a third embodiment of the present invention. This embodiment is different from the second embodiment in that the present invention is applied to an isolated structure with a transformer, instead of a non-isolated structure. In this embodiment, the light emitting device driver circuit 46 includes a light emitting device control circuit 49, which operates a power switch Q4 to control a primary current of a transformer circuit 47, such that a proper secondary current is generated and supplied to the LED circuit 11. After generating the latching current for firing the TRIAC device, the light emitting device driver circuit 46 controls the power switch Q4 according to a feedback signal obtained at a feedback pin FB, and regulates the current supplied to the LED circuit 11. This embodiment shows that the present invention is not limited to the non-isolated light emitting device driver circuit 36 as shown in FIG. 5; the present invention may be applied according to any light emitting device power supply circuit with the TRIAC dimming circuit 12, as long as it generates the latching current for firing the TRIAC dimming circuit by the power stage circuit, and guides the latching current to the load circuit under control by a light emitting device control circuit. The spirit of the present invention should cover all such and other modifications and variations.

Figure 8:
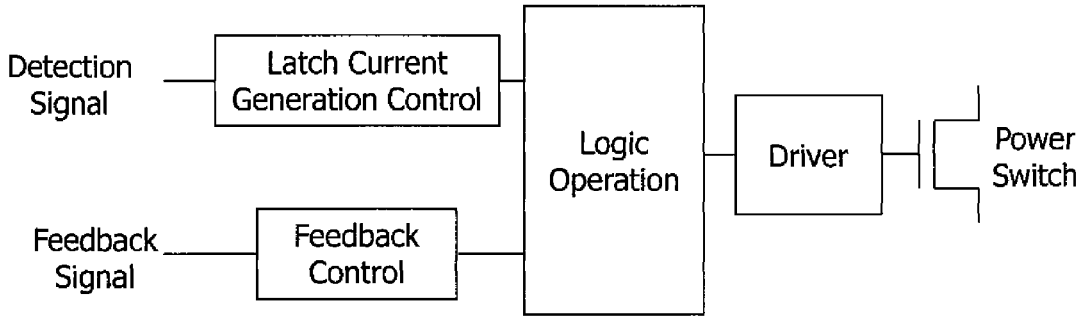
FIG. 8 is a block diagram explaining how the light emitting device driver circuit controls the power switch.

FIG. 8 is a block diagram explaining how the light emitting device driver circuit controls the power switch. The detection signal (in FIG. 5, this detection signal is for example the signal obtained at the pin DIM; in FIG. 7, this detection signal is for example the signal obtained at the pin DIM or at the pin SEN) indicates the time point when the rectified dimming signal is at the neutral level or when the inductor current is zero, for controlling the power switch to generate the inrush current, such that the latching current can be generated. The feedback signal (in FIG. 5, this feedback signal is for example the signal obtained at the pin SEN; in FIG. 7, this feedback signal is for example the signal obtained at the pin FB or at the pin SEN) indicates whether the regulated object (such as the output voltage or the output current of the power stage circuit) reaches a predetermined target, for controlling the power switch to regulate the object. The detection signal and the feedback signal are subject to a logic operation to generate the switch control signal, and the driver gate converts the switch control signal to a proper level for controlling the power switch.

Figure 9:
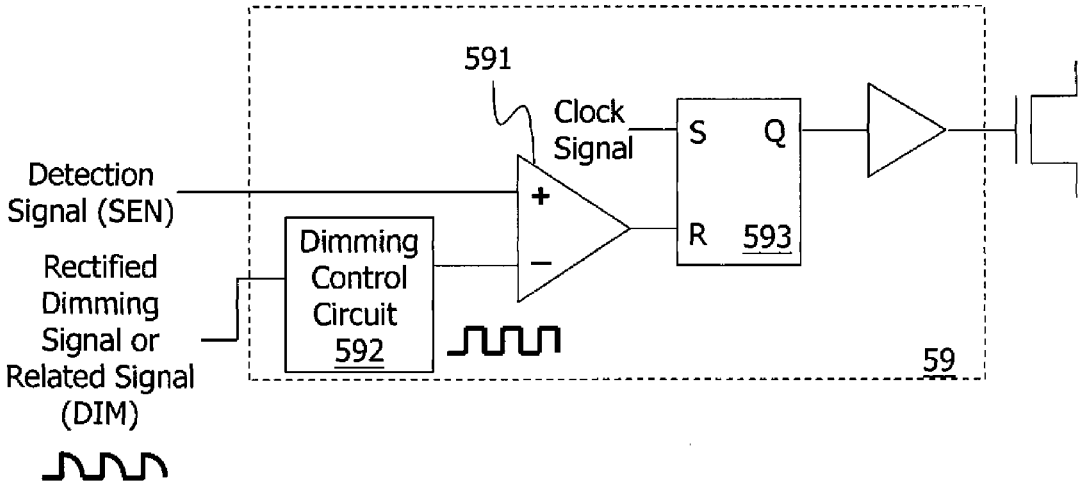
FIG. 9 shows a fourth embodiment of the present invention.

FIG. 9 shows a fourth embodiment of the present invention, which is one specific example embodying the concept shown in FIG. 8. As shown in the figure, the light emitting device control circuit 59 includes a comparator circuit 591, a dimming control circuit 592, and a latch circuit 593. The comparator circuit 591 directly or indirectly compares the detection signal with a dimming reference signal, and generates a trigger signal which is inputted to the latch circuit 593. The detection signal is for example the signal obtained from the pin SEN shown in FIG. 5, and the dimming reference signal is for example the rectified dimming signal obtained from the pin DIM shown in FIG. 5. The dimming control circuit 592 generates a PWM signal according to the rectified dimming signal, wherein the duty ratio of the PWM signal is related to the trigger phase of the rectified dimming signal. (Thus, the comparator circuit 591 indirectly compares the detection signal with the dimming reference signal, because it compares the detection signal with the PWM signal converted from the dimming reference signal. It can also be arranged so that the comparator circuit 591 directly compares the detection signal with a dimming reference signal.) The latch circuit 593 is for example but not limited to an SR flip-flop circuit as shown in the figure. In every period, when the rectified dimming signal has not yet reached the trigger phase, the inductor current is zero, and the detection signal is also zero, so the comparator circuit 591 does not trigger a reset operation of the latch circuit 592 (no input signal at terminal R); therefore, the latch circuit 593 generates an output signal with 100% duty ratio to keep turning ON the power switch. When the rectified dimming signal reaches the trigger phase, the inductor current is not zero, so the detection signal is not zero either; hence, the duty ratio of the output signal of the latch circuit 593 is determined by the comparison result of the detection signal and the output signal of the dimming control circuit 592, such that the ON time of the power switch is determined.

FIG. 9 shows only one example of the light emitting device control circuit. The purpose of this specific embodiment is for meeting the enabling requirement, not for limiting the present invention. For example, the constant frequency structure shown in FIG. 9 may be changed to a varying frequency structure, or the dimming control circuit 592 may be omitted or modified. The present invention should cover all such modifications and variations.

The present invention has been described in considerable detail with reference to certain preferred embodiments thereof. It should be understood that the description is for illustrative purpose, not for limiting the scope of the present invention. Those skilled in this art can readily conceive variations and modifications within the spirit of the present invention. For example, a device which does not substantially influence the primary function of a signal can be inserted between two devices shown in direction connection in the shown embodiments, such as a switch or the like. For another example, the positive and negative inputs of the comparators, the inputs to the S and R terminals of the latch circuit 593, and the N-type and P-type of the power switch are interchangeable, with corresponding amendment of the circuits processing these signals or definitions of the high/low levels. In view of the foregoing, the spirit of the present invention should cover all such and other modifications and variations, which should be interpreted to fall within the scope of the following claims and their equivalents.

What is claimed is:

1. A light emitting device driver circuit for driving a light emitting device circuit according to a rectified dimming signal, wherein the rectified dimming signal is generated from an AC input signal which passes through a tri-electrode AC switch (TRIAC) dimming circuit and a rectifier circuit, the light emitting device driver circuit comprising:

a power stage circuit coupled between the rectifier circuit and the light emitting device circuit, the power stage circuit operating at least one power switch therein according to a switch control signal to generate a latching current for firing the TRIAC dimming circuit, wherein the latching current flows through the light emitting device circuit; and a light emitting device control circuit coupled to the power stage circuit, the light emitting device control circuit generating the switch control signal according to a detection signal;

wherein the detection signal is generated according to the rectified dimming signal or a signal related to the rectified dimming signal, and the detection signal is generated when the rectified dimming signal changes from a neutral level to a predetermined level, and wherein the switch control signal turns ON the power switch continuously for a predetermined period.

2. A light emitting device driver circuit for driving a light emitting device circuit according to a rectified dimming signal, wherein the rectified dimming signal is generated from an AC input signal which passes through a tri-electrode AC switch (TRIAC) dimming circuit and a rectifier circuit, the light emitting device driver circuit comprising:

a power stage circuit coupled between the rectifier circuit and the light emitting device circuit, the power stage circuit operating at least one power switch therein according to a switch control signal to generate a latching current for firing the TRIAC dimming circuit, wherein the latching current flows through the light emitting device circuit; and a light emitting device control circuit coupled to the power stage circuit, the light emitting device control circuit generating the switch control signal according to a detection signal;

wherein the detection signal is generated according to at least one method below:

(1) by detecting the rectified dimming signal or a signal related to the rectified dimming signal, and the detection signal is generated when the rectified dimming signal is at a neutral level or below a predetermined level;

(2) by detecting an input or an output current flowing through the power stage circuit or a signal related to the input or the output current, and the detection signal is generated when the input or the output current is zero; and (3) by generating the detection signal with a frequency corresponding to a frequency of the AC input signal or the rectified dimming signal.

3. The driver circuit of claim 2, further comprising a voltage detection circuit coupled to the rectifier circuit to detect the rectified dimming signal or the signal related to the rectified dimming signal.

4. The driver circuit of claim 2, wherein the power stage circuit further includes:

a current detection circuit coupled to the power switch to detect the input or the output current; and an inductor device coupled to the power switch to generate the latching current.

5. The driver circuit of claim 2, wherein in one operation period of the power switch, the light emitting device control circuit first controls the power switch to generate the latching current according to the detection signal, and then, after the latching current is generated, the light emitting device control circuit controls the power switch to regulate an output voltage or an output current of the power stage circuit to a predetermined target according to a feedback signal.

6. The driver circuit of claim 2, wherein the light emitting device control circuit includes:

a comparator circuit, which compares the detection signal and the rectified dimming signal or a signal related to the rectified dimming signal, for generating a trigger signal according to the comparison result; and a latch circuit, which determines an ON time of the switch control signal according to the trigger signal.

7. A light emitting device control method, comprising:

receiving a rectified dimming signal, which is generated from an AC input signal which passes through a tri-electrode AC switch (TRIAC) dimming circuit and a rectifier circuit;

generating a switch control signal according to a detection signal;

controlling at least one power switch of a power stage circuit according to the switch control signal to generate a latching current for firing the TRIAC dimming circuit; and inputting the latching current to the light emitting device;

wherein the detection signal is generated according to the rectified dimming signal or a signal related to the rectified dimming signal, and the detection signal is generated when the rectified dimming signal changes from a neutral level to a predetermined level; and the step of generating the latching current includes: turning ON the power switch continuously for a predetermined period by the switch control signal according to the detection signal.

8. A light emitting device control method, comprising:

receiving a rectified dimming signal, which is generated from an AC input signal which passes through a tri-electrode AC switch (TRIAC) dimming circuit and a rectifier circuit;

generating a switch control signal according to a detection signal;

controlling at least one power switch of a power stage circuit according to the switch control signal to generate a latching current for firing the TRIAC dimming circuit; and inputting the latching current to the light emitting device;

wherein the detection signal is generated according to at least one method below:

(1) by detecting the rectified dimming signal or a signal related to the rectified dimming signal, and the detection signal is generated when the rectified dimming signal is at a neutral level or below a predetermined level;

(2) by detecting an input or an output current flowing through the power stage circuit or a signal related to the input or the output current, and the detection signal is generated when the input or the output current is zero; and (3) by generating the detection signal with a frequency corresponding to a frequency of the AC input signal or the rectified dimming signal.

9. The control method of claim 8, wherein in one operation period of the power switch, the power switch is first controlled to generate the latching current according to the detection signal, and the control method further comprising: after the latching current is generated, the power switch is then controlled to regulate an output voltage or an output current of the power stage circuit to a predetermined target according to a feedback signal.

10. The control method of claim 8, wherein the step of generating the switch control signal includes:

comparing the detection signal with the rectified dimming signal or a signal related to the rectified dimming signal, and generating a trigger signal according to the comparison result; and determining an ON time of the switch control signal according to the trigger signal.

11. A light emitting device power supply circuit, comprising:

a tri-electrode AC switch (TRIAC) dimming circuit for generating an AC dimming signal according to an AC input signal;

a rectifier circuit for generating a rectified dimming signal according to the AC dimming signal; and a light emitting device driver circuit for driving a light emitting device circuit according to the rectified dimming signal, the light emitting device driver circuit including:

a power stage circuit coupled between the rectifier circuit and the light emitting device circuit, the power stage circuit operating at least one power switch therein according to a switch control signal to generate a latching current for firing the TRIAC dimming circuit, wherein the latching current flows through the light emitting device circuit; and a light emitting device control circuit coupled to the power stage circuit, the light emitting device control circuit generating the switch control signal according to a detection signal;

wherein the detection signal is generated according to the rectified dimming signal or a signal related to the rectified dimming signal, and the detection signal is generated when the rectified dimming signal changes from a neutral level to a predetermined level, and wherein the switch control signal turns ON the power switch continuously for a predetermined period.

12. A light emitting device power supply circuit, comprising:

a tri-electrode AC switch (TRIAC) dimming circuit for generating an AC dimming signal according to an AC input signal;

a rectifier circuit for generating a rectified dimming signal according to the AC dimming signal; and a light emitting device driver circuit for driving a light emitting device circuit according to the rectified dimming signal, the light emitting device driver circuit including:

a power stage circuit coupled between the rectifier circuit and the light emitting device circuit, the power stage circuit operating at least one power switch therein according to a switch control signal to generate a latching current for firing the TRIAC dimming circuit, wherein the latching current flows through the light emitting device circuit; and a light emitting device control circuit coupled to the power stage circuit, the light emitting device control circuit generating the switch control signal according to a detection signal;

wherein the detection signal is generated according to at least one method listed below:

(1) by detecting the rectified dimming signal or a signal related to the rectified dimming signal, and the detection signal is generated when the rectified dimming signal is at a neutral level or below a predetermined level;

(2) by detecting an input or an output current flowing through the power stage circuit or a signal related to the input or the output current, and the detection signal is generated when the input or the output current is zero; and (3) by generating the detection signal with a frequency corresponding to a frequency of the AC input signal or the rectified dimming signal.

13. The power supply circuit of claim 12, further comprising a voltage detection circuit coupled to the rectifier circuit to detect the rectified dimming signal or the signal related to the rectified dimming signal.

14. The power supply circuit of claim 12, wherein the power stage circuit further includes:

a current detection circuit coupled to the power switch to detect the input or the output current; and an inductor device coupled to the power switch to generate the latching current.

15. The power supply circuit of claim 12, wherein in one operation period of the power switch, the light emitting device control circuit first controls the power switch to generate the latching current according to the detection signal, and then, after the latching current is generated, the light emitting device control circuit controls the power switch to regulate an output voltage or an output current of the power stage circuit to a predetermined target according to a feedback signal.

16. The power supply circuit of claim 12, wherein the light emitting device control circuit includes:

a comparator circuit, which compares the detection signal and the rectified dimming signal or a signal related to the rectified dimming signal, for generating a trigger signal according to the comparison result; and a latch circuit, which determines an ON time of the switch control signal according to the trigger signal.

* * * * *